US007704071B2

(12) United States Patent
Liu et al.

(10) Patent No.: US 7,704,071 B2
(45) Date of Patent: Apr. 27, 2010

(54) ACTUATOR WITH LED PENLIGHT FOR PIEZOELECTRIC LIGHTER

(76) Inventors: Lily Liu, 17 Preston La., Hicksville, NY (US) 11801; ZhanGen Wei, Rm 1404, #1228 South ZhongShan Rd., Shanghai, JiangSu (CN) 200011

( * ) Notice: Subject to any disclaimer, the term of this patent is extended or adjusted under 35 U.S.C. 154(b) by 932 days.

(21) Appl. No.: 11/429,602

(22) Filed: May 8, 2006

(65) Prior Publication Data

US 2007/0259297 A1 Nov. 8, 2007

(51) Int. Cl.
*F23D 11/36* (2006.01)

(52) U.S. Cl. ..... 431/253; 431/153; 431/254; 431/255; 362/109; D27/142

(58) Field of Classification Search ..... 431/253, 431/153, 254, 255, 256, 257, 129, 132; 362/84, 362/109; D27/141, 142, 154
See application file for complete search history.

(56) References Cited

U.S. PATENT DOCUMENTS 6,520,658 B2 * 2/2003 Chen ..... 362/84

* cited by examiner

*Primary Examiner*—Alfred Basichas

(57) ABSTRACT

Disclosed is an actuator for a piezoelectric cigarette or utility lighter with a LED penlight incorporated as an independent light source. The actuator is located at the top of a standard piezoelectric lighter behind the lighter's burner. The actuator activates the lighter when it is depressed and makes contact with a piezoelectric unit that initiates release of gas into the burner while simultaneously emitting a spark in the area of the burner to ignite the gas. The penlight feature consists of an LED light assembly incorporated into the actuator's top cap situated so as to depress the piezoelectric unit. The LED light assembly consists of a light emitting diode mounted on a platform, the whole of which is configured to fit within the LED top cap whereby the platform is a bottom wall of the LED top cap and contains a power source in the form of a battery holder that fits between the piezoelectric unit and the outer casing of the lighter. A pressure switch on the actuator operates the penlight.

4 Claims, 10 Drawing Sheets

ACTUATOR WITH LED PENLIGHT FOR PIEZOELECTRIC LIGHTER

BACKGROUND OF THE INVENTION

1. Field of the Invention

The present invention relates to a piezoelectric lighter with an actuator that operates the ignition system of a cigarette or utility lighter and also contains an independent light source, i.e., a miniature lighting device commonly known as a penlight, key light, or miniature flashlight, specifically those that utilize a light emitting diode (LED) of high brightness as a light source.

2. Background of the Invention

Penlights and other miniature light devices have a wide variety of uses, from illuminating poorly lit areas and dark, narrow spaces for any number of reasons to locating keys and locks. They are often used to read documents in cars or in poorly lit areas, as well as to identify persons or things in such areas. In the absence of a flashlight or penlight, cigarette lighters are frequently used as a light source in situations where a penlight would be useful While lighters may work in some situations, there is always the danger of inadvertently starting a fire. Moreover, a cigarette lighter can be used for illumination only very briefly without the real danger of suffering a burn injury to the hand.

However, until very recently, equipping a piezoelectric lighter with a separate, reliable light source was simply impracticable because of the space requirements for the light source. The only cigarette lighters known to also contain an independent light source are those where an LED light is installed at the bottom end of the lighter, opposite to the end containing the burner and lighter actuator. In order to use such a light source, the lighter has to be reversed. This arrangement has several obvious disadvantages, especially if the light source is to be used in an unlit, dark area where the lighter may be lost or mishandled in the process of attempting to operate it. More significantly, a piezoelectric lighter with the LED light assembly at the bottom end—an assembly that requires at a minimum the LED device, a power source and a switch mechanism—will utilize almost as much space as the lighter components, which would include a piezoelectric unit, a fuel reservoir, a gas line and burner assembly, as well as an actuator to ignite the lighter. In the ordinary course of use, such a cigarette lighter would have an abbreviated life. First, because the light source is at the bottom, the LED assembly would receive many shocks since that end of the cigarette lighter would always be regarded as the base end and would be handled accordingly. Thus, the likelihood of it breaking is twice that of the ordinary lighter.

More important, however, a piezoelectric lighter with an LED light assembly at its bottom end would have to have a very small and limited fuel reservoir because of the space utilized for the LED light assembly. Thus, if such a lighter is not refillable, its usefulness as a lighter would be extremely limited, as would be its marketability. It would probably be discarded before its light source expires. On the other hand, even if it is refillable, it will have to be refilled twice as often as an ordinary refillable lighter, having half the fuel capacity. In either case, a piezoelectric lighter with a LED light assembly at the bottom end would have less commercial value than one with the LED light at the top end of the lighter. The present invention remedies those disadvantages by incorporating the LED light source into the actuator behind the burner of the lighter.

SUMMARY OF THE INVENTION

Thus there is a need for a cigarette or utility lighter with an independent light source at the same end as the lighter's burner and one that has the same fuel capacity as the ordinary, conventional lighter without an independent light source. Such features would extend the life of the lighter and make it more user friendly, and thereby more commercially viable.

The object of this invention is to provide a reliable, user friendly, independent light source that can be combined with a conventional lighter to enhance its utility as both a miniature flashlight and cigarette or utility lighter, without sacrificing its useful life and fuel capacity. Accordingly, several objects and advantages of the present invention over the prior art are:

a) To provide an actuator for a piezoelectric lighter that incorporates an LED light assembly that includes an LED, a power source, and a switch mechanism that can be operated with a simple movement of the thumb.

b) To provide an actuator for a piezoelectric lighter that incorporates an LED penlight in such a manner that the LED component will not utilize space dedicated to the lighter's fuel supply.

c) To provide a cigarette lighter with an independent light source, i.e., a penlight or miniature flashlight, that will have the same fuel capacity as the ordinary, conventional lighter without an independent light source.

d) To provide a cigarette lighter with an independent light source at the top end of the lighter, next to the lighter burner for the most convenient handling and user friendly position.

e) To provide an actuator for a cigarette lighter that incorporates an LED light assembly that is positioned next to the lighter burner at the top end of the lighter to minimize damage from handling shocks.

f) To provide an actuator for a cigarette lighter that incorporates an LED light assembly by using a simplified construction and design that integrates the LED device, the power source, and the switch mechanism in the most economical and cost effective way.

g) To provide an actuator that incorporates an LED lighting assembly that can be adapted to the greatest range of piezoelectric lighter embodiments in the art.

In this regard, the present invention provides an actuator for a piezoelectric cigarette or utility lighter which has an incorporated LED light assembly as an independent light source, commonly called a penlight. The actuator is embodied in a standard, conventional piezoelectric lighter with an elongated outer body casing defining a fuel reservoir enclosed by an inner fuel reservoir casing, and a fuel dispensing assembly consisting of a fuel line with a valve that regulates the flow of fuel to a burner atop the fuel assembly. A lighter top cap covers half of the lighter's top end, enclosing the burner and a pair of vertical arms that secure a fireproof partition across the top of the lighter. The fireproof partition separates and shields the LED light assembly incorporated in the actuator from the lighter burner. The fuel released by the burner is ignited by an electric spark generated by a piezoelectric unit that is positioned behind the fuel dispensing assembly and above a portion of the fuel reservoir. The piezoelectric unit generates a spark to the burner through a spark conductor when a smaller top member is telescoped into a larger bottom member of the unit by downward, vertical pressure on the actuator which is slidable. The slidable actuator covers the other half of the top end of the lighter and is positioned behind the lighter top cap and directly over the piezoelectric unit. The downward pressure on the actuator also releases fuel into the burner at the same time that it generates an electric spark and, thereby, creates a flame. The actuator is configured such that, when depressed, it not only causes the piezoelectric unit to emit the electric spark into the area of the burner, it also causes a gas lever to open the valve regulating the flow of gas to the burner. The gas lever extends from the gas valve on the gas line to the piezoelectric unit, where it is configured to be depressed when the actuator telescopes the top member of the piezoelectric unit, thereby causing the other end of the gas lever to open the gas valve on the gas line. A controllable flame from the burner results. When downward pressure on the actuator ceases, a spring within the piezoelectric unit providing resistance to the downward pressure forces the actuator upwards to its original position. As a result, pressure on the gas lever is relieved and the gas valve closes, extinguishing the flame.

The instant invention is a lighter actuator with an incorporated LED light assembly which will provide a reliable, user friendly, independent light source in addition to igniting the lighter. The actuator is generally in two parts. The first part is an integrally molded, helmet shaped, LED top cap constructed so as to slidably fit on top of the lighter behind the lighter top cap and burner, separated by a fireproof partition. The helmet shaped, LED top cap includes a back wall and two opposite side walls extending downward from a top wall, all of which define a cavity that receives the second part of the actuator. The second part of the actuator is the upper portion of the LED light assembly, which includes an LED bulb with two contact leads on an LED platform which has a battery holder for three or less batteries attached. The top wall of the LED top cap has an aperture through which the light beam from the LED shines. The aperture is defined by a round heat guard that extends downwards from the opening and is sized to receive the LED bulb when the LED top cap is assembled with the LED light assembly to complete the actuator. Two abbreviated flanges extending from the top of the open end of the LED top cap are configured to slidably connect the LED top cap to the lighter body by articulating with connecting channels on the vertical arms extending from the top of the lighter body. Fitting within the vertical connecting channel, the flanges provide a slidable means for the depression of the actuator. The back wall of the LED top cap has a small bore for a LED pressure light switch. And, on the inside of the LED top cap are slight, molded vertical ribs in the back and front to provide a means for connecting and stabilizing the LED light assembly when inserted. At the open end of the LED top cap, the free ends of the two vertical side walls are configured to provide a seal with the folded edges of the lighter cap when the LED top cap is fitted to the lighter.

The LED assembly consists of a LED bulb of suitable size and type with two contact leads, one short and the other long, extending therefrom. The LED bulb rests atop of and is adhered to a LED platform that includes a flat, horizontal base bisected by a longitudinal, vertical post on which the LED bulb is positioned. The horizontal base provides a solid floor to the LED top cap and a surface to depress the piezoelectric unit's top member to activate the lighter. The LED assembly also includes a power source consisting of three flat, cell batteries contained in a battery holder, attached at a right angle to the underside of the LED platform base at the end next to the back wall of the LED cap when the actuator is assembled. The effect of the LED bulb and platform fitting within the LED cap, along with the perpendicular, flatten battery holder as the power source is to utilize the least amount of space for an independent light source. The three (3) cylindrical, flat cell batteries, of sufficient voltage to power the LED, inserted in three (3) vertically aligned battery compartments on the battery holder requires less space than the piezoelectric unit. In fact, the battery holder utilizes unused space within the lighter body because it fits within the unused space between the outer casing and the piezoelectric unit.

The operation of the penlight feature of the lighter is a simple matter of turning the lighter in the direction one wants the light beam to illuminate and pressing the light switch located on the outside of the back wall of the LED top cap. The short lead on the LED bulb runs to the area of the light switch, adjacent to, but not touching a flexible conductive plate that runs from the negative terminal of the first cell battery on the battery holder. The conductive plate is flexible to a degree that when the light switch is pressed inward against it, the conductive plate flexes and makes contact with the short lead, thereby closing a circuit and powering the LED penlight. The electric circuit also consists of the long lead extending down from the LED bulb, along the back side of the battery holder where it makes contact with the positive terminal of the third battery through a bore in its battery compartment. On its opposite side, the negative terminal of the third battery makes contact with the positive terminal of the second battery by means of a conductive plate clipped to the surface of those two batteries. The negative terminal of the second battery is similar linked to the positive terminal of the first battery by a conductive plate in their adjoining battery compartments. This simple, elegant arrangement of 3 flat, cell batteries linked by conductive plates sets up an electric circuit which is closed and powers up the LED bulb when the light switch is depressed. As with the lighter flame and the actuator, the LED light is extinguished when pressure on the light switch is removed.

DRAWINGS

Reference Numerals

| | | | | | |
|---|---|---|---|---|---|
| 2 | preferred embodiment lighter | | | | |
| 10 | lighter top cap | 11 | lighter cap sidewall | 12 | lighter aperture |
| 13 | lighter cap top wall | 14 | lighter burner | 16 | fuel valve |
| 18 | fuel line | 20 | penlight actuator | 22A | short lead |
| 22B | long lead | 24A-24C | conductive plates | | |
| 26A-26B | clips | 28A | top battery | 28B | middle battery |
| 28C | bottom battery | 29A-29C | battery compartments | | |
| 30 | LED top cap | 32 | LED aperture | 34 | light switch |
| 36 | heat guard | 38 | LED bulb | 40 | vertical arm |
| 42 | partition | 44 | connecting channel | 46 | folded edge |
| 50 | flange | 51 | LED cap back wall | 52 | LED cap sidewall |
| 53 | back rib | 54 | front rib | 55 | LED top wall |
| 60 | piezoelectric unit | 60A | top member | 60B | bottom member |
| 62 | piezoelectric spring | 64 | spark conductor | 66 | LED platform |
| 68 | fuel lever | 70 | outer casing | 72 | fuel reservoir casing |
| 74 | fuel reservoir | 76 | bottom cap | 78 | fuel cap |
| 80 | LED battery holder | 82 | LED light assembly | 84 | LED platform base |
| | | 86 | LED platform post | | |

DETAILED DESCRIPTION OF THE PREFERRED EMBODIMENT

Although a specific embodiment of the present invention will now be described with reference to the drawings, the following description is only one example of a variety of specific embodiments representative of the principles of the present invention. Various changes and modifications obvious to one skilled in the art pertaining to the present invention are deemed to be within the spirit, scope and contemplation of the present invention as further defined in the appended claims.

Figure 1:
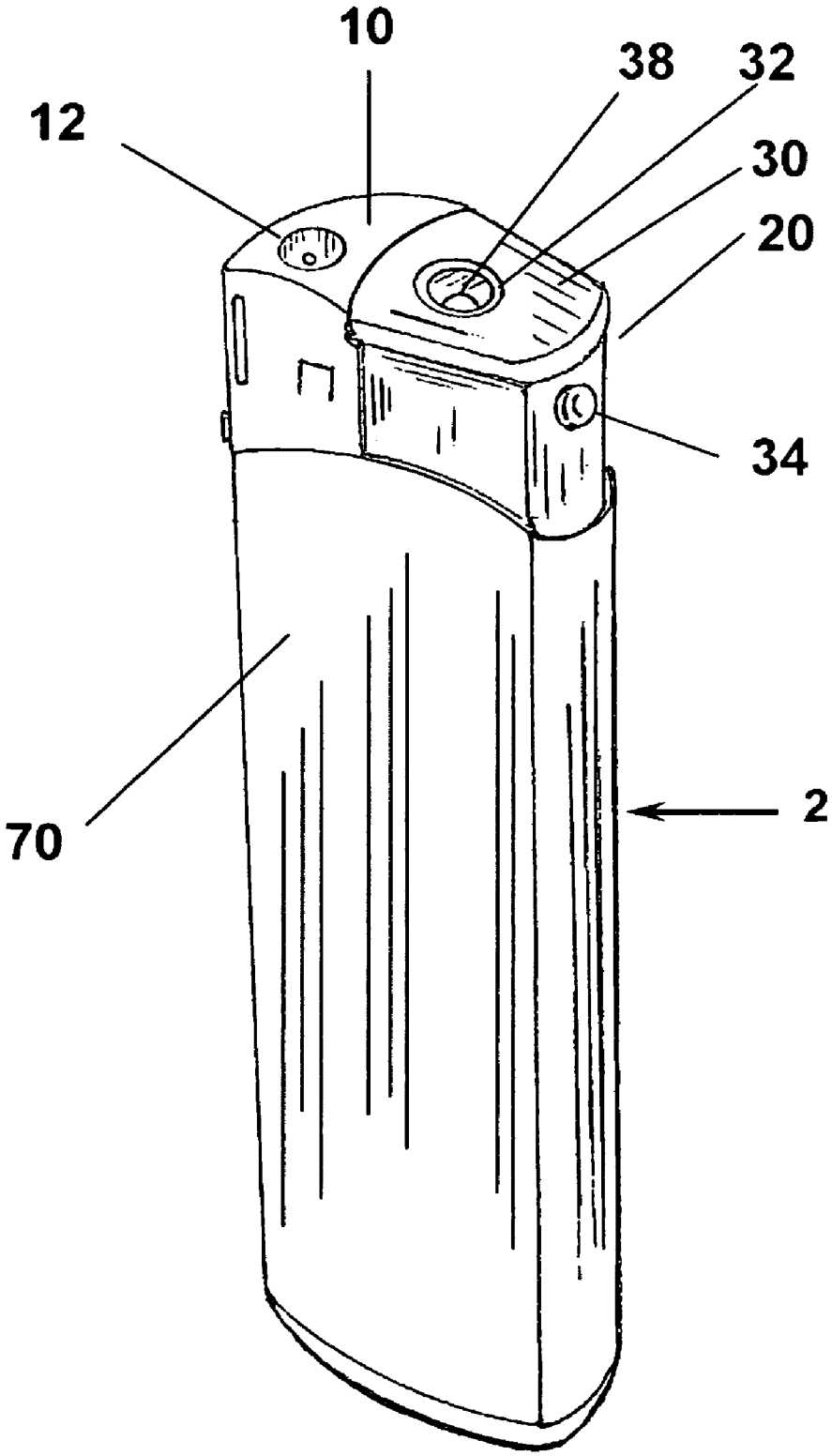
FIG. 1 is a perspective view of a standard piezoelectric cigarette lighter embodying the present actuator with an independent light source, i.e., an LED penlight.

FIG. 1 depicts a preferred embodiment of the present invention—an actuator with a LED penlight incorporated as an independent light source in a standard piezoelectric cigarette lighter. It shows a lighter 2 with an attractive exterior consisting generally of three parts—a top cap for the lighter 10, the LED top cap 30 of the penlight actuator 20 and the elongated outer casing 70. The lighter top cap 10 has a lighter aperture 12 for the flame. The actuator 20 contains an aperture 32 for the LED light beam, wherein can be seen an Led bulb 38. A light switch 34 for the LED penlight is also depicted.

Figure 2:
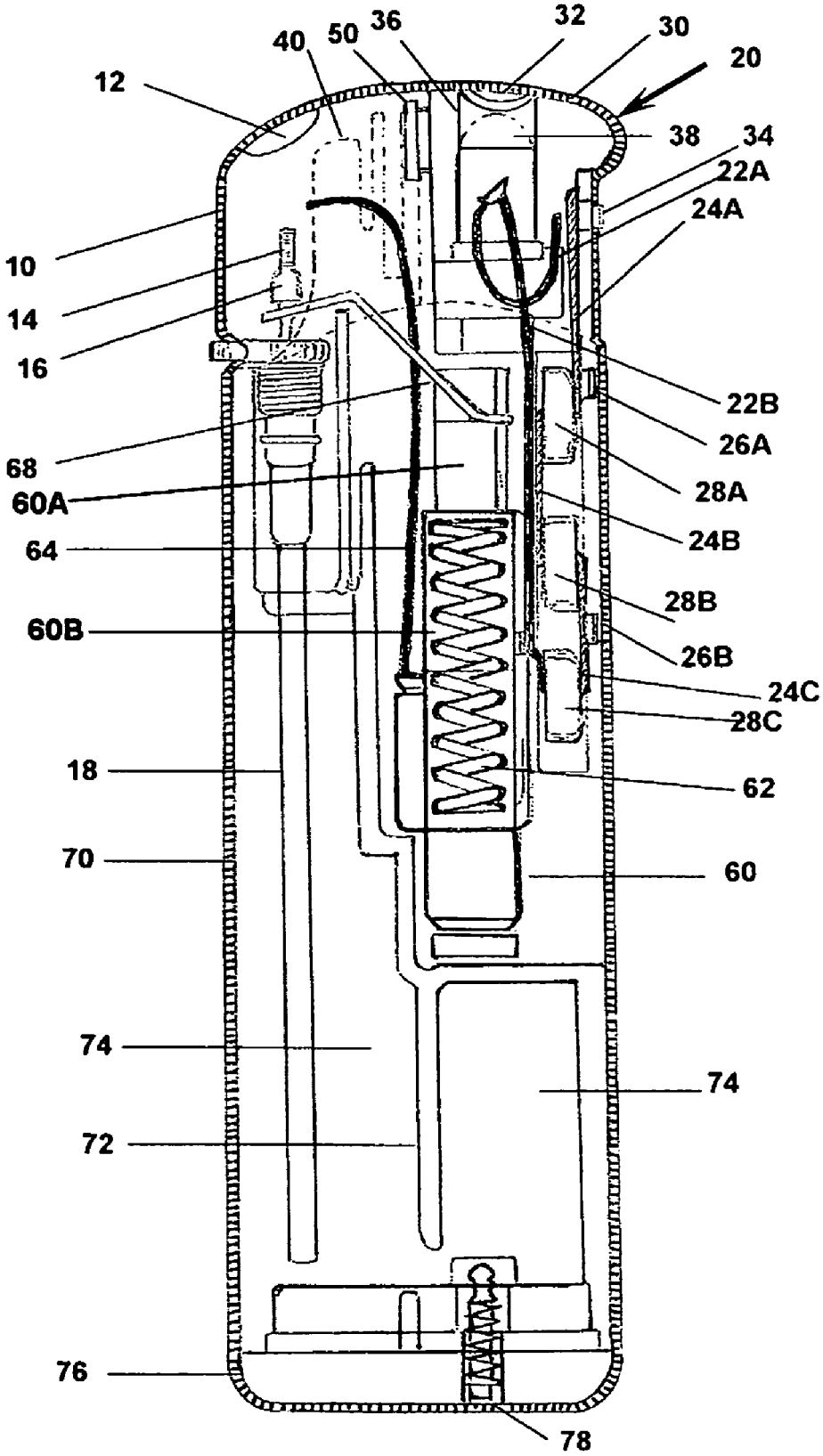
FIG. 2 is a cross section, schematic view showing the structure of a standard piezoelectric lighter fully assembled with the actuator.
Figure 3:
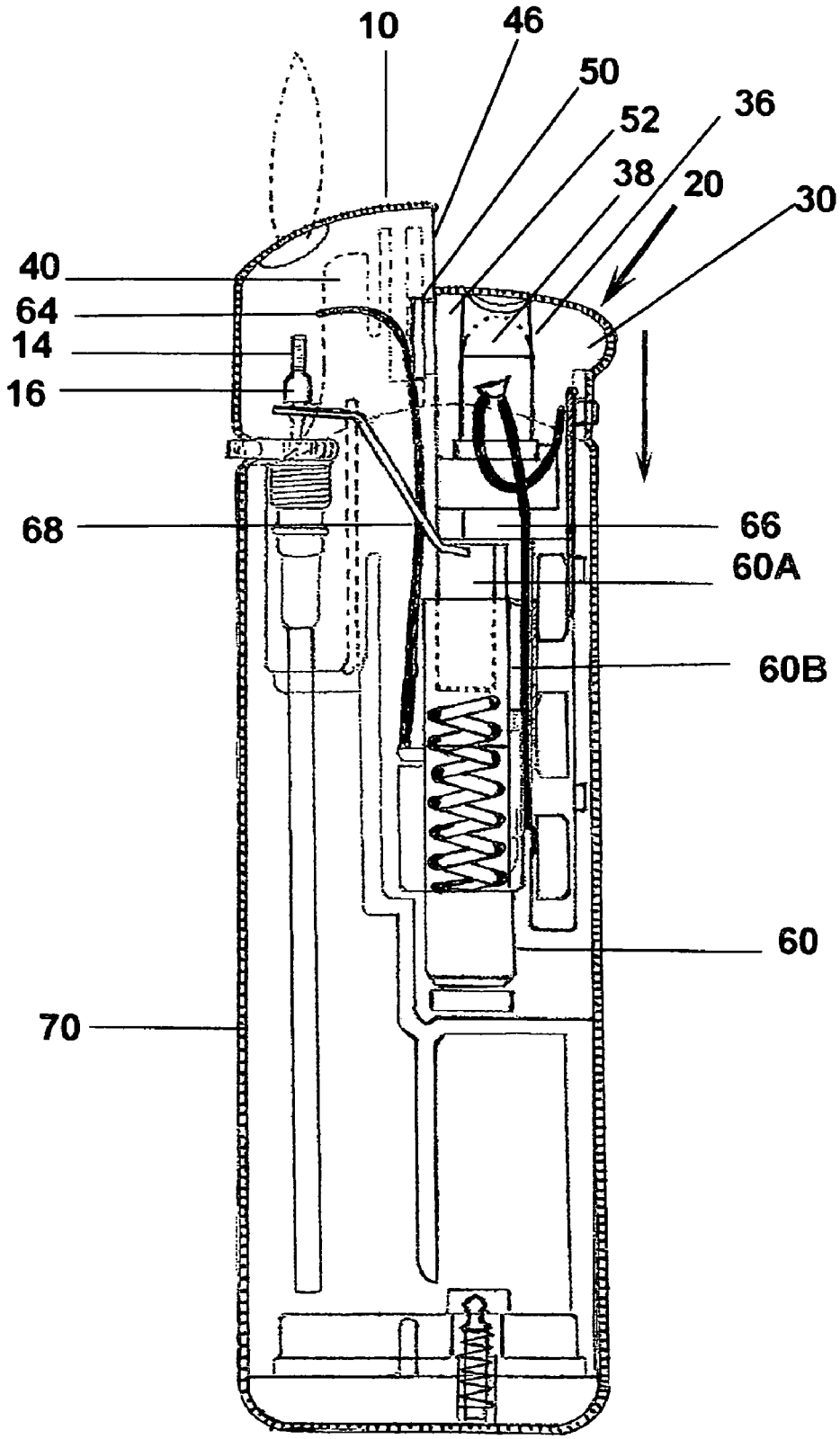
FIG. 3 is a cross section schematic view of the lighter in FIG. 1 showing the action of the lighter when the actuator is depressed to ignite the lighter.

FIG. 2 is a cross section, schematic view of lighter 2 in FIG. 1 showing the structure of a standard piezoelectric lighter fully assembled with the penlight actuator 20. It portrays an outer casing 70 along with a fuel reservoir casing 72 defining a fuel reservoir 74. At the bottom end is a bottom cap 76 that contains a fuel cap 78 through which the fuel reservoir 74 may be filled with an appropriate fuel for the lighter. Also displayed is a fuel dispensing assembly that includes a fuel line 18 that leads to a fuel valve 16 that releases fuel to a burner 14 that is atop the fuel dispensing assembly and beneath the lighter aperture 12, through which the flame emanates. To the right of and parallel to the fuel reservoir casing 72 is the piezoelectric unit 60, consisting of a small top member 60A and a large bottom member 60B containing a spring 62. A spark conductor 64 runs from the piezoelectric unit 60 up to the area of the burner 14. A fuel lever 68 extends from the small top member 60A of the piezoelectric unit 60 on one end to the fuel valve 16 on the other end. The fuel lever 68 regulates the release of fuel to the burner 14 in response to the action of the small member 60A of the piezoelectric unit 60. As seen in FIG. 3, when the small member of the piezoelectric unit 60A is depressed and telescoped within the larger bottom member 60B because of pressure on the actuator 20, a spark is emitted from the spark conductor 64 in the area of the burner 14, while at the same time fuel is released into the burner 14 as a result of the fuel lever 68 opening the fuel valve 16. A flame results from this cascade of events.

Figure 4:
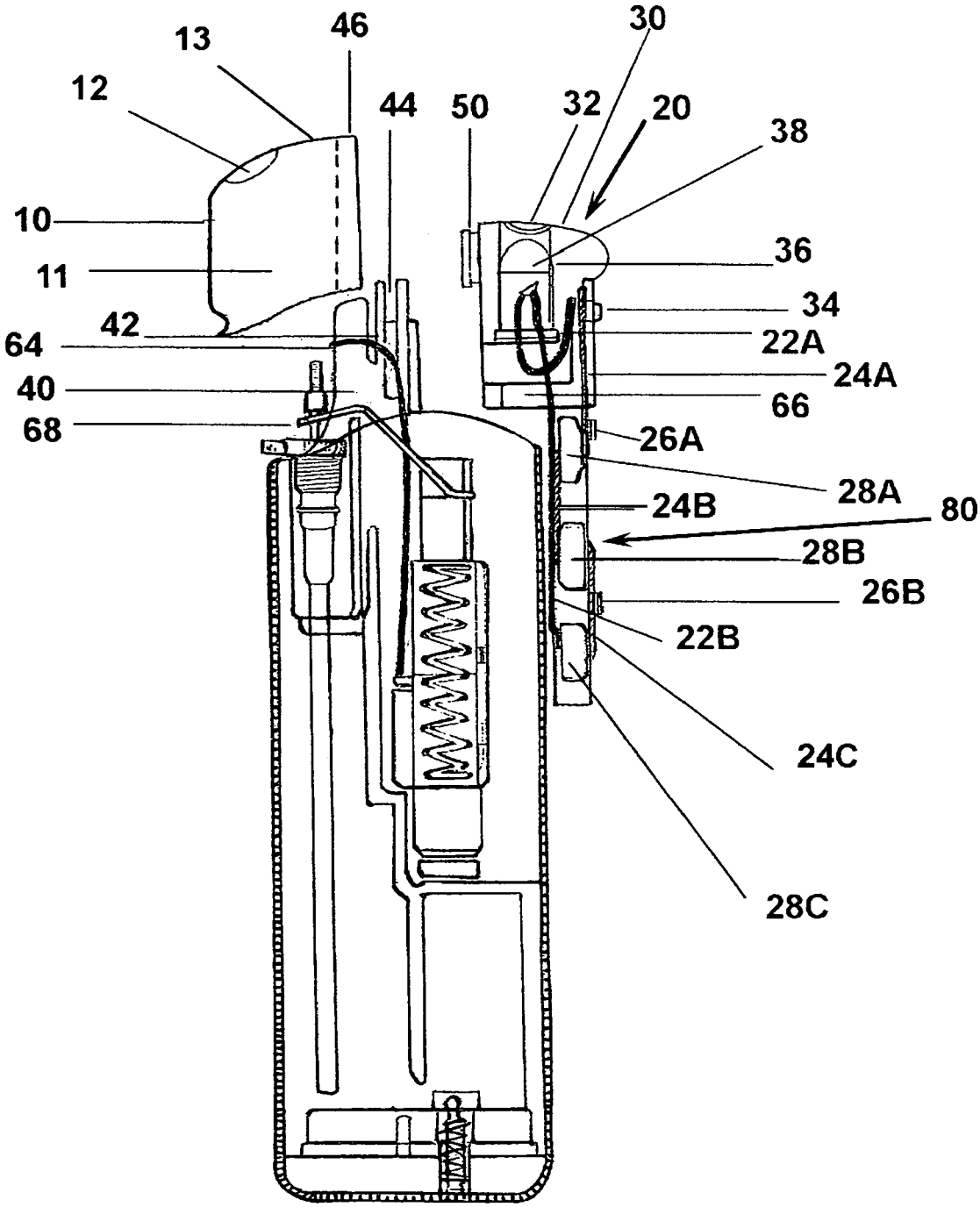
FIG. 4 is an exploded, schematic, cross section view of the lighter in FIG. 1 showing the lighter top cap, the actuator with an LED penlight assembly and a standard piezoelectric lighter.

Two vertical arms, one of which 40 can be seen in cross section on FIGS. 2 & 3 and in the exploded, perspective view of FIG. 4, extend vertically from the top of the outer casing 70. The vertical arm 40 can be adhered to or integrally molded with the outer casing 70. The vertical arm 40, mirrored on the opposite, parallel side of the outer casing 70 secures one end of a fireproof partition 42. The partition 42, secured on both ends by a vertical arm 40, shields the penlight actuator 20 incorporated in the LED top cap 30 from the flame of the burner 14 and holds the spark conductor 64 in proximity to the burner 14. The partition 42 is constructed of material that is nonflammable and heat resistant. Also, as depicted in FIG. 4. the vertical arm 40 contains a connecting channel 44, which is duplicated on the parallel, opposite side vertical arm not depicted in the drawings. The connecting channel 44 provides a slidable means for the depression of the actuator 20, necessary to operate the lighter. As seen in FIGS. 2, 3, & 4, and describe in further detail herein below, on each side of a top cap 30 of actuator 20 is a flange 50 that fits within the slidable connecting channel 44 and allows the actuator 20 to be depressed. FIG. 4 also shows the lighter top cap 10 in the present embodiment as helmet shaped with a top wall 13 conjoined with two curving sidewalls 11 forming a closed front end. The lighter top cap 10 encloses the burner 14 and the vertical arms 40. Although the lighter top cap 10 may adhere or attach to the outer casing 70 of the lighter in different ways, in the present embodiment it is designed with the free ends of the side walls 11 at the open end having folded edges 46 to provide a means for securing the lighter top cap 10 to the top of lighter 2. This is achieved by fitting a folded edge 46 on both sides of the open end of the lighter top cap 10 around the back edge of the vertical arm 40. This connective arrangement also allows a seal to be created with the LED top cap 30 of the actuator 20. When the flange 50 on the LED top cap 30 is positioned within the slidable connecting channel 44 of the vertical arm 40, the folded edge 46 of the lighter top cap is flush with the open end of the LED top cap sidewall 52. This is depicted in FIG. 3 which shows the actuator 20 depressed and both top caps in juxtaposition. Thus, not only is the lighter top cap 10 connected firmly to the lighter, the position of its folded edges 46 flush against the ends of the LED top cap sidewall 52 creates a seal with the actuator, as the exploded view of FIG. 5B suggests.

FIGS. 2 & 3 also show the unique and innovative construct of the present lighter actuator with an incorporated LED penlight 20 assembled within the preferred lighter embodiment 2 The design and construct of the actuator 20 enables it to be placed directly above the small, telescopic member 60A of the piezoelectric unit 60. Thus the penlight actuator 20 is in a position to initiate ignition of lighter 2 in the usual manner that a standard piezoelectric is operated—by depression of the telescopic member of the piezoelectric unit. The actuator 20, however, does not require additional space in the standard lighter 2 because of the penlight feature, since the LED 38 is incorporated within the LED top cap 30, as seen in FIGS. 3, 4, 5A, & 5B.

FIGS. 2 & 3 depict a cross-sectional view of the penlight actuator 20 composed of an LED top cap 30 enclosing a LED bulb 38 atop an LED platform 66 and disposed within a heat guard 36. The heat guard 36, sized to receive the LED bulb 38, extends down from the LED aperture 32. The heat guard 36 focuses and concentrates the light from the LED bulb 38 into a coherent beam of light through the LED aperture 32. The heat guard 36 also provides additional protection from the lighter's flame and heat. As depicted in FIG. 3, the LED platform 66, being disposed directly above, depresses the small member 60A of the piezoelectric unit when the actuator 20 is depressed, thereby generating a spark through the spark conductor 64 in the area of the burner 14. At the same time, fuel is released into the burner 14 when the small member 60A of the piezoelectric unit 60 is depressed because the fuel lever 68, articulating with the small member 60A, is similar depressed, thereby opening the fuel valve 16 on the other end of the fuel lever 68 and releasing fuel into the burner 14. The cascading effect resulting from pressure on the actuator ignites the lighter. When pressure on the actuator 20 is removed, the piezoelectric spring 62 within the large bottom member of the piezoelectric unit drives the actuator 20 back to its original position, as seen in FIG. 2. In another embodiments, not depicted, the fuel valve 16 may also contain a means for pre-setting the amount of fuel entering the burner 14 and thus regulating the height of the flame that emanates from the burner.

Figure 5A:
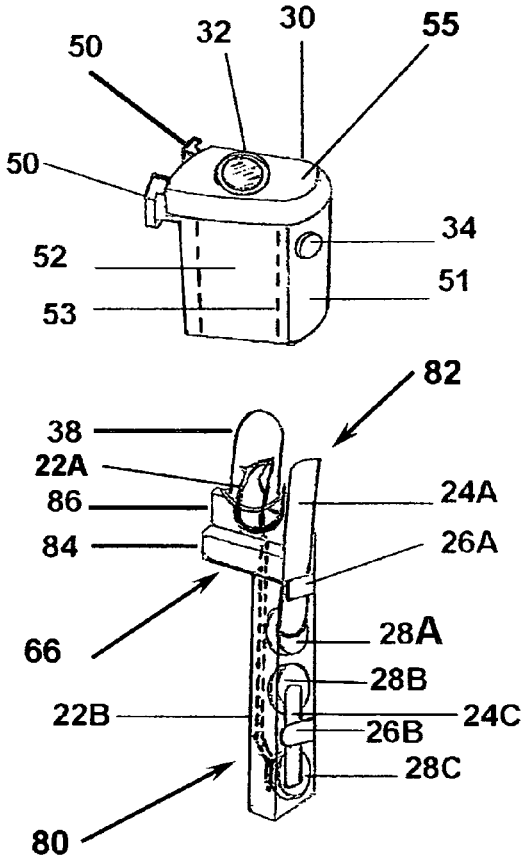
FIG. 5A is an exploded, perspective view of the actuator showing perspective views of the LED top cap and the LED light assembly, consisting of the LED bulb, LED platform, and the battery holder.
Figure 5B:
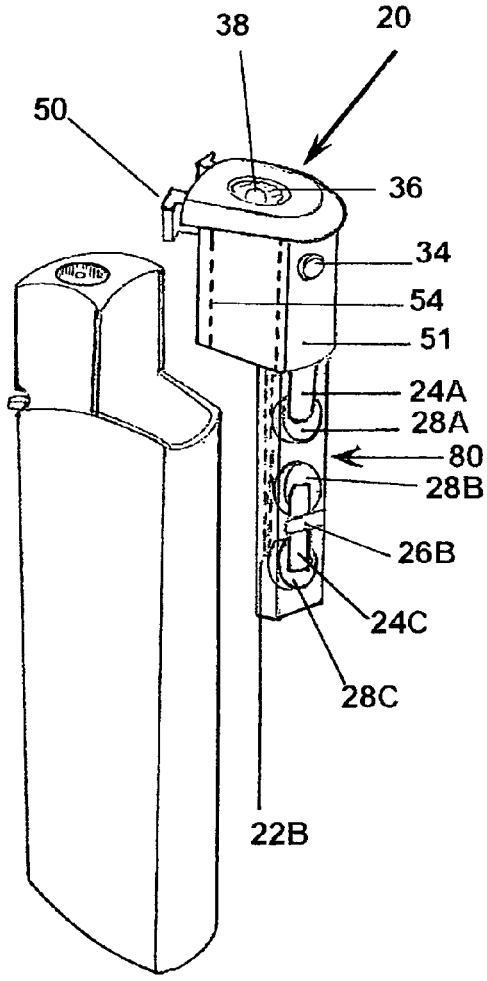
FIG. 5B is a perspective view of the LED top cap and LED light assembly assembled into the actuator in relationship to the lighter.

FIG. 4 is an exploded, perspective, cross section view of lighter 2, its lighter top cap 10, and its penlight actuator 20 with a LED top cap 30 and a battery holder 80. FIGS. 5A and 5B are exploded, perspective view of the actuator 20, including the helmet shaped LED top cap 30 and a LED light assembly 82, composed of a LED bulb 38 atop a LED platform 66 and a battery holder 80. The LED top cap 30 has two opposite sidewalls 52 joined to a back wall 51 and a LED top wall 55. The back wall 51 of the LED top cap 30 has a pressure light switch to operate the LED light, while the top wall 55 has an aperture 32 for a LED light beam. The open ends of the LED sidewalls 52 have flanges 50 extending out. As stated before, the flanges 50 enable the depression of the actuator 20 when positioned within the connecting channel 40. Molded within the LED top cap side walls 52 are slight ribs 53 at the back end and ribs 54 at the front end which help stabilize and connect the LED bulb 38 and Platform 66 when inserted into the LED top cap 30. FIG. 5A also shows the construction of the LED platform 66 which has a base 84 portion and a post 86 portion. Constructed out of the same rigid, nonconductive plastic that composes the battery holder, the LED platform must be of sufficient strength and durability to withstand the pressure of depressing the top member 60A of the piezoelectric unit. The power source for the LED bulb 38 is illustrated in FIG. 5A as a battery holder 80 that extends down from one end of the LED platform 66. FIG. 5B depicts the position of the battery holder 80 when the actuator 20 is assembled with the LED bulb 38 inside the LED top cap 30. In that position, the battery holder 80 is next to the back wall 51 of the LED top cap 30.

Figure 6A:
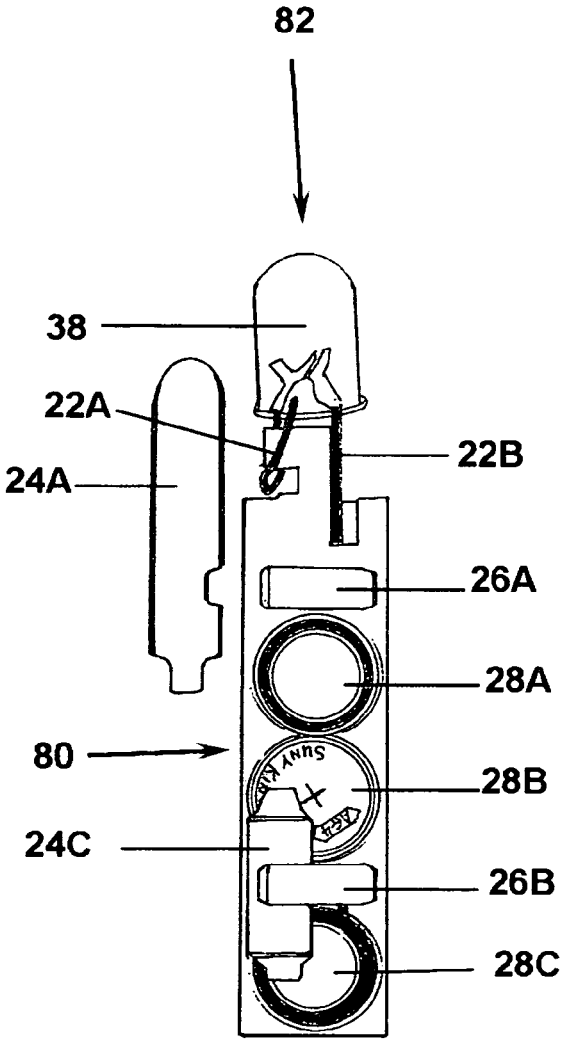
FIG. 6A and FIG. 6B are perspective front views of the LED light assembly showing the arrangements of the LED bulb with two leads, the battery holder with batteries, and conductor plates.
Figure 6B:
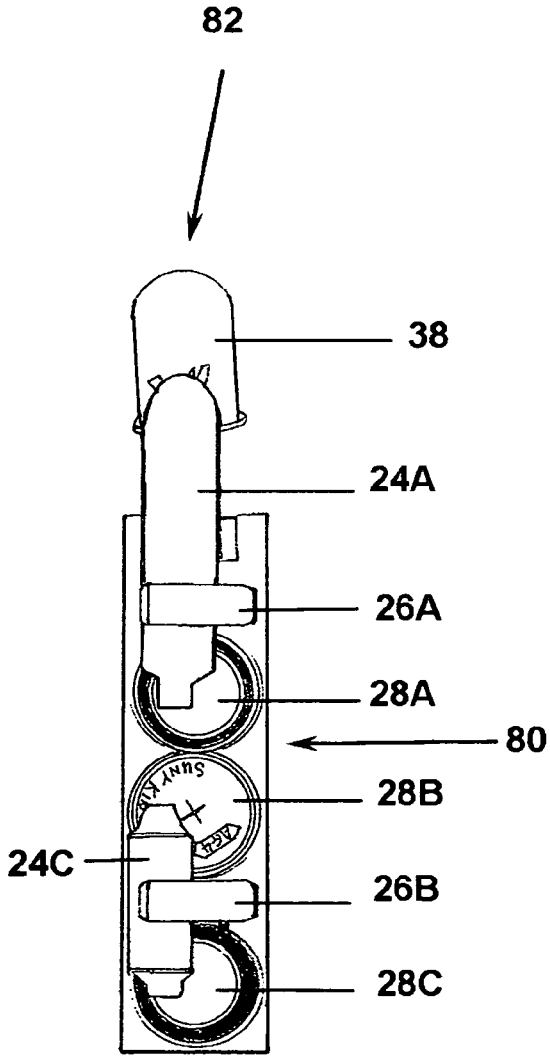
Figure 7A:
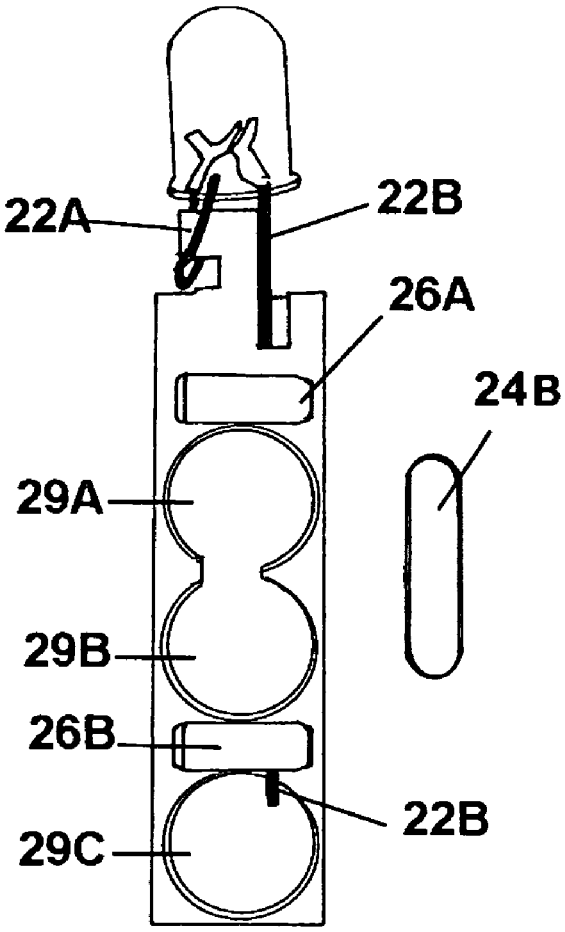
FIG. 7A and FIG. 7B are perspective front views of the LED light assembly showing the structure of the battery holder without batteries in the battery compartments but with a conductive plate inside the top and middle battery compartments.
Figure 7B:
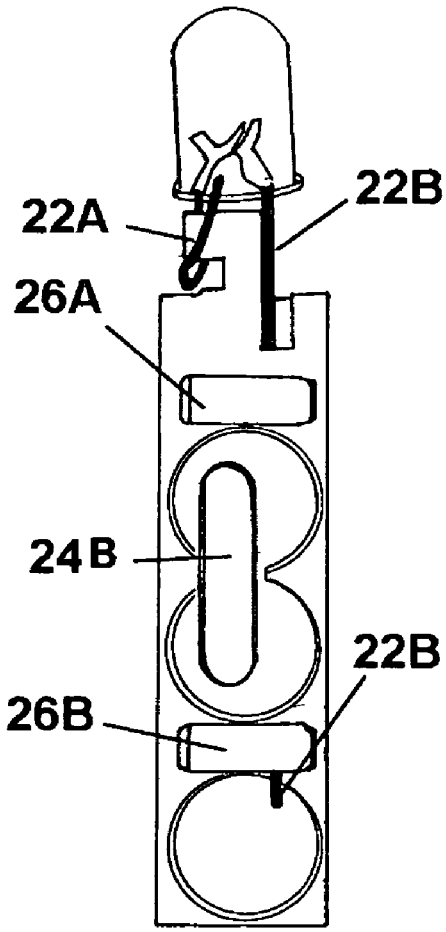

The exploded, cross-section view of the actuator in FIGS. 4, 5A & 5B and the schematic views of FIGS. 6A, 7A & 7B, all show the actuator 20 with a conventional LED 38 with two leads, a short lead 22A and a long lead 22B, that connect with the power source in order to establish the necessary electrical circuit. In FIG. 4, the short lead 22A is seen curling down over the LED platform 66 up towards the area of a conductive plate 24A and the light switch 34. The short lead 22A may adhere to the LED Platform 66 in some manner AND/or be set in a groove or notch to stabilize its path. The long lead 22B is seen to travel down the backside of battery holder 80 to the bottom battery. The path of the long lead 22B can be seen on FIGS. 4, 5A, 7A, & 7B. As shown thereon, the long lead 22B travels behind the battery compartments 29A, 29B, & 29C, finally entering compartment 29C so as to make contact with a battery that is inserted, as in FIGS. 6A & 6B. The long lead 22B may also set in a groove or adhere to the surface of the battery holder in some manner to guide and stabilize its path. FIGS. 6A & 6B are schematic views of the front side of the battery holder 80 that faces the LED top cap back wall 51. FIGS. 5A & 6A show the battery holder 80 with three batteries inserted 28A, 28B & 28C. FIGS. 5A & 6B show a clip 26A securing a conductive plate 24A to the surface of the negative side of the top battery 28A at one end, while the other end of the conductive plate 24A is adjacent to the short lead 22A that travels from the LED bulb 38. The conductive plate 24A can be composed of any thin, flexible, highly conductive material. When the actuator is assembled, the conductive plate 24A makes contact with the negative side of the top battery 28A at one end and the other end is disposed between the light switch 34 and the short lead 22A as depicted in FIGS. 2 & 4. To illuminate the LED bulb 38 and thereby operate the LED penlight actuator 20, the electric circuit is closed by pressure on the light switch 34 which pushes the flexible conductive plate to make contact with the short lead 22A, thereby closing the circuit and powering up the LED bulb 38.

Figure 8A:
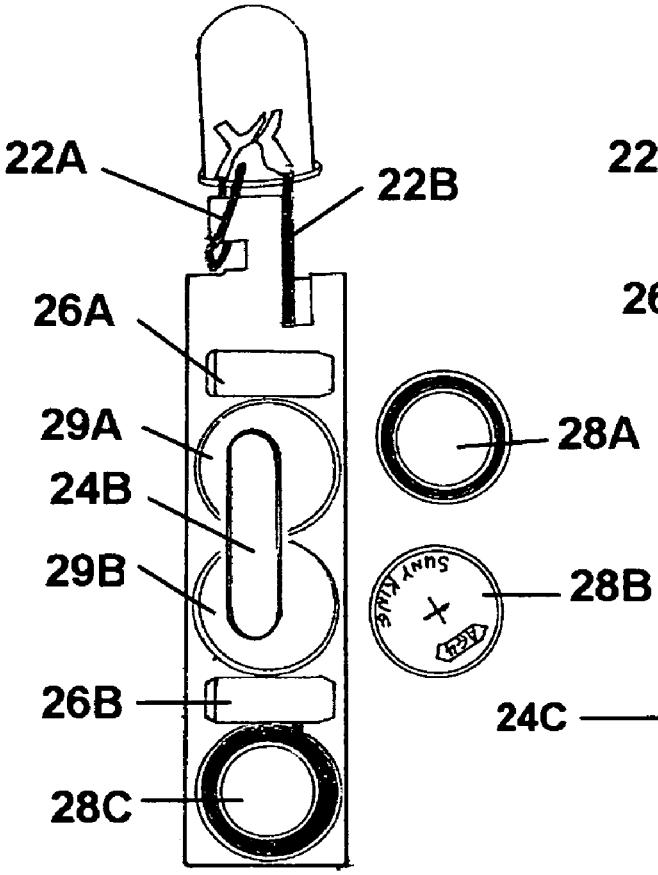
FIGS. 8A and 8B is a perspective front view of the LED light assembly showing the placement of the conductor plates in the battery holder in relationship to the placement of the batteries.
Figure 8B:
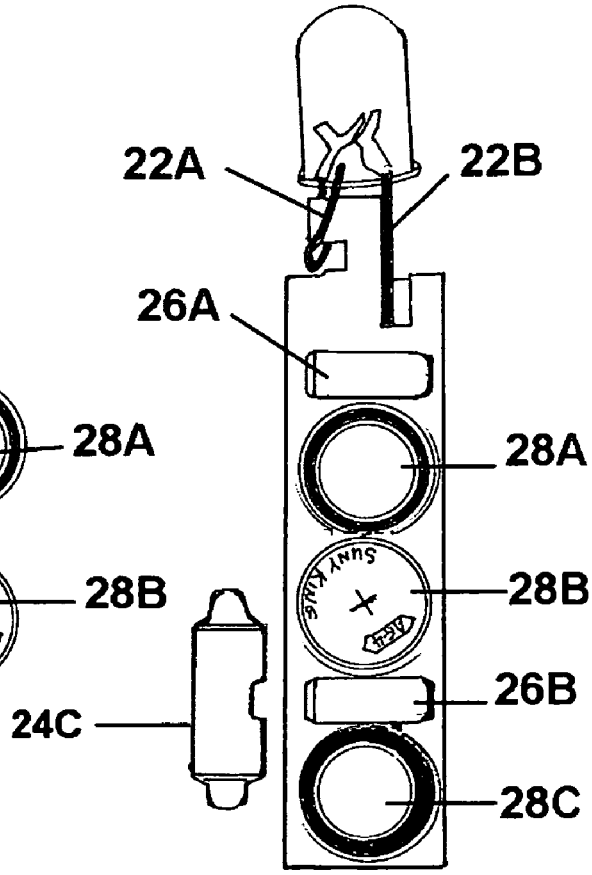
Figure 9:
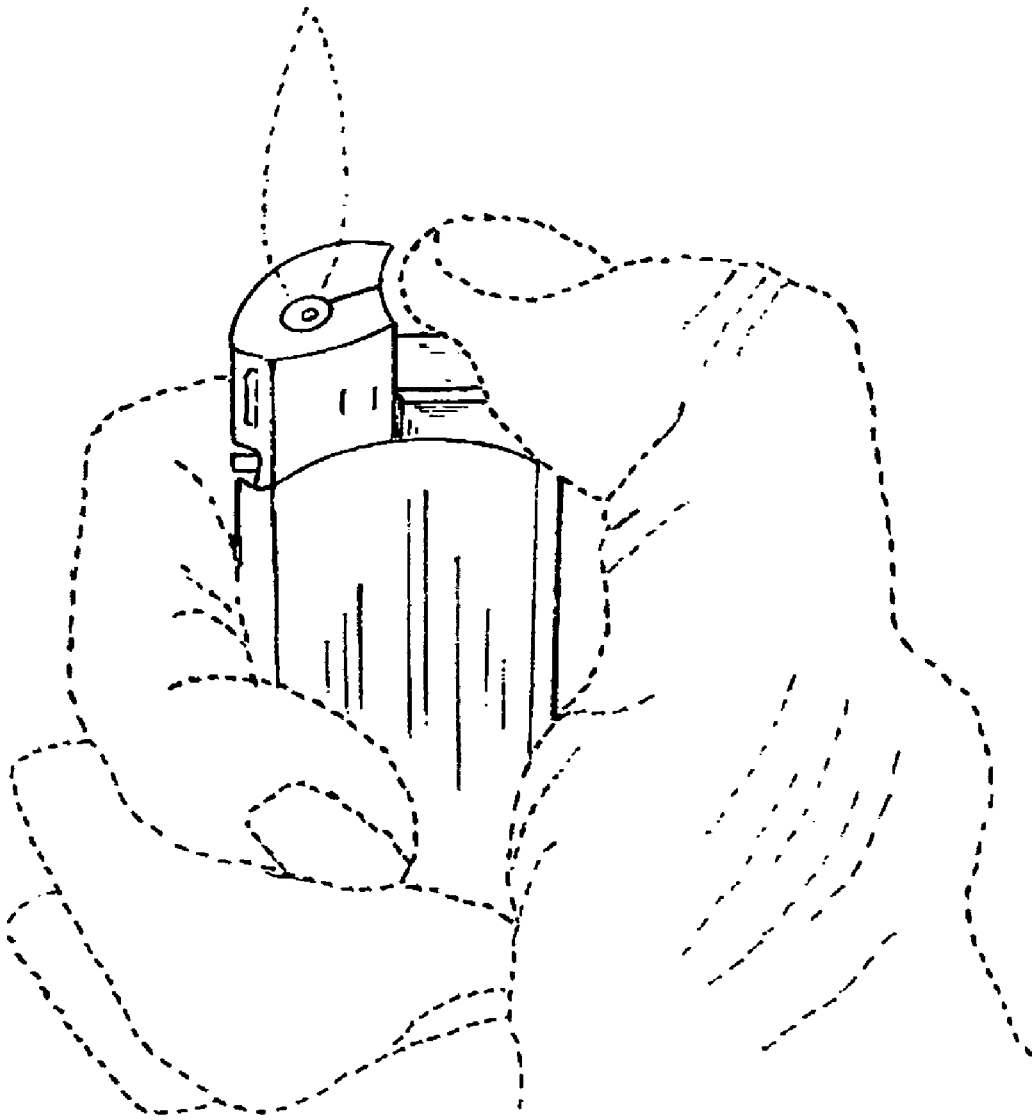
FIG. 9 is perspective view of the orientation of a piezoelectric lighter with an LED penlight actuator in the hand during the operation of the lighter feature.
Figure 10:
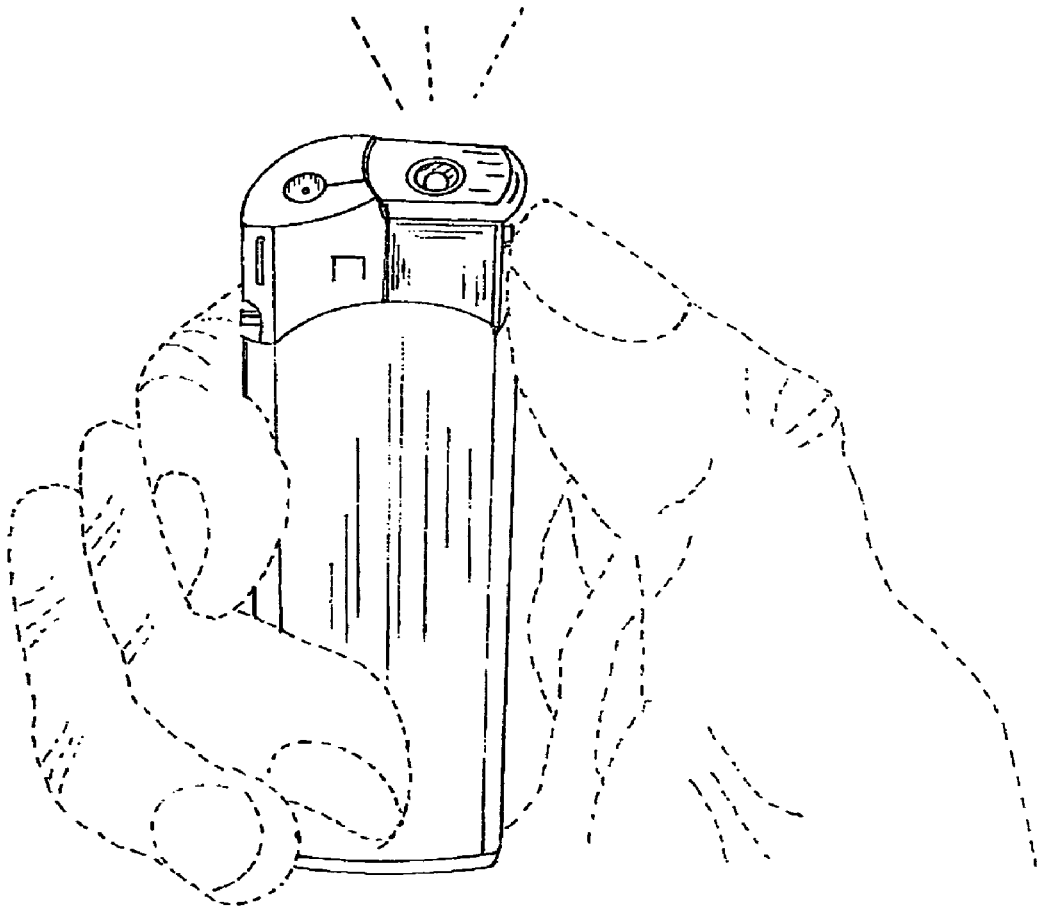
FIG. 10 is a perspective view of the orientation of a piezoelectric lighter with an LED penlight actuator in the hand during the operation of the LED penlight.

FIGS. 6A & 6B illustrate the balance of the circuit created by the three batteries, which includes a conductive plate 24C straddling the middle battery 28B and the bottom battery 28C and secured by a clip 26*b*. Conductive plate 24C makes contact with the positive side of the middle battery 28B and the negative side of the bottom battery 28C. The circuit is completed by a conductive plate 24B straddling the positive side of the top battery 28A and the negative side of the middle battery 28B. FIGS. 7A & 7B show the empty battery compartments 29A and 29B and the placement of a conductive plate 24B at the bottom of the empty battery compartments 29A and 29B. FIGS. 8A & 8B depict how the top battery 28A and the middle battery 28B are placed on top of the conductive plate 24B straddling the conjoined battery compartments 29A and 29B. Thus an electric circuit consisting of three, flat cell batteries of suitable voltage is completed. The circuit is closed when the light switch 34 is pushed in, causing conductive plate 24A to contact the short lead 22A, resulting in the illumination of the LED penlight in the actuator 20.

It is clear from the foregoing description of the structure and operation of the LED penlight actuator for a piezoelectric lighter in a preferred embodiment that the instant invention provides a simple and elegant construction of a lighter with a Led penlight actuator. The LED penlight actuator is not only cost efficient and simple to operate (by the simple movement of the thumb), it can be adapted to greatest range of piezoelectric lighter embodiments in the art. Moreover, the invention enhances the commercial appeal of the ordinary lighter since the actuator adds the independent light source at the top of the lighter without sacrificing fuel capacity. Although this invention has been disclosed and illustrated with reference to a particular embodiment, the intention is not to limit the scope of the present invention. It will be apparent to those skilled in the art that various equivalent modifications in structure, features, assembling, and rearrangements of the parts may be made without departing from the spirit and scope of the underlying inventive concepts indicated by the appended claims.

What is claimed is:

1. A piezoelectric lighter with a penlight actuator, comprising:

an outer lighter casing enclosing a fuel reservoir, a fuel dispensing assembly, and a telescopic piezoelectric unit;

said telescopic piezoelectric unit having a small top member and a larger bottom member with a spring therein and a spark conductor extending therefrom, and said top member articulating with said fuel dispensing assembly by means of a fuel lever attached to a fuel valve that releases fuel into a burner when the top member is depressed;

a lighter top cap mounted on a front end of said outer casing and containing an aperture for a flame and enclosing the upper parts of the lighter mechanism, including said burner, said fuel dispensing assembly, said spark conductor, a penlight actuator comprising:

a slidable LED top cap enclosing a LED light assembly and integrally formed by a top wall containing an aperture for a LED light beam defined by a heat guard, connecting with two side walls and a back wall containing a pressure light switch and a bottom wall in the form of a LED platform;

said slidable LED top cap mounted on the outer casing behind the lighter top cap and a fireproof partition and situated directly over the piezoelectric unit so as to depress the piezoelectric unit in a telescopic fashion when the penlight actuator is depressed and thereby release fuel into said burner and simultaneously emit an electric spark through the spark conductor to ignite the lighter;

said LED light assembly includes a LED bulb mounted on said LED platform and sized to fit within said heat guard, having a long contact lead connecting to a power source and a short contact lead connecting to said light switch mechanism which allows the penlight to be operated independent of the operation of the lighter;

said power source consists of three or less flat cell batteries of suitable voltage electronically linked so that an electrical circuit is established when the long lead makes contact with the positive side of said linked batteries and the short lead makes contact with the negative side of said linked batteries as a result of pressure on the light switch, thereby activating the LED bulb and enabling the operation of the LED penlight independent of the lighter operation;

said LED platform contains a battery holder and is configured to form the solid bottom wall for the LED top cap as a means to depress the telescopic piezoelectric unit, with the battery holder configured to fit between the piezoelectric unit and the outer casing.

2. The lighter of claim 1 wherein the LED platform consists of a flat base portion with a perpendicular post portion on top and the battery holder extending downward from the base portion sized to fit between the piezoelectric unit and the outer casing.

3. The lighter of claim 2 wherein said flat cell batteries are electronically linked to one another and to the light switch by a flexible conductive plate.

4. The lighter in claim 3 wherein the light switch, operated by pressure, protrudes from the back wall of the LED top cap adjacent to said flexible conductive plate from the battery holder and the short lead from the LED bulb.

* * * * *